US006763790B2

(12) United States Patent
Watson et al.

(10) Patent No.: US 6,763,790 B2
(45) Date of Patent: Jul. 20, 2004

(54) POPPET VALVE ACTUATOR

(75) Inventors: John P. Watson, Naperville, IL (US); William de Ojeda, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 46 days.

(21) Appl. No.: 10/044,867

(22) Filed: Jan. 10, 2002

(65) Prior Publication Data

US 2002/0121251 A1 Sep. 5, 2002

Related U.S. Application Data

(63) Continuation-in-part of application No. 09/457,908, filed on Dec. 8, 1999, now Pat. No. 6,338,320, which is a continuation-in-part of application No. 09/152,497, filed on Sep. 9, 1998, now Pat. No. 6,044,815.

(51) Int. Cl.[7] ..... F01L 9/02

(52) U.S. Cl. ..... 123/90.12; 123/90.39; 123/90.48; 123/90.15

(58) Field of Search ..... 123/90.12, 90.39, 123/90.43, 90.45, 90.46, 90.48, 90.49, 90.52, 90.55, 90.56, 90.57, 90.15, 90.16, 90.17, 90.41, 90, 42, 90.13, 90.44, 90.47, 90.5, 90.51, 90.53, 90.54; 74/569

(56) References Cited

U.S. PATENT DOCUMENTS 4,502,425 A * 3/1985 Wride ..... 123/90.12
4,892,067 A * 1/1990 Paul et al. ..... 123/90.12
4,901,684 A * 2/1990 Wride ..... 123/90.16
5,002,022 A * 3/1991 Perr ..... 123/90.12
5,117,213 A * 5/1992 Kreuter et al. ..... 335/219
5,224,683 A 7/1993 Richeson
5,248,123 A 9/1993 Richeson et al.
5,287,829 A 2/1994 Rose
5,379,737 A * 1/1995 Hu ..... 123/322
5,529,030 A 6/1996 Rose
5,829,397 A * 11/1998 Vorih et al. ..... 123/90.12

* cited by examiner

*Primary Examiner*—Thomas Denion
*Assistant Examiner*—Jaime Corrigan
(74) *Attorney, Agent, or Firm*—Dennis Kelly Sullivan; Susan L. Lukasik; Jeffrey P. Calfa

(57) ABSTRACT

A valve actuator assembly for actuating a valve, the valve having a longitudinal axis includes an electrohydraulic actuator being displaced a lateral distance from the valve longitudinal axis, and a rocker arm being rotatable about a hinge point, a first arm portion extending from the hinge point to a proximal end and a second arm portion extending from the hinge point to a distal end, the proximal end being operably coupled to the second stage piston and the distal end being operably coupled to the valve, the fist arm portion being shorter than the second arm portion, the rocker arm spanning the lateral distance. A method of stroke amplification is further included.

41 Claims, 6 Drawing Sheets

POPPET VALVE ACTUATOR

RELATED APPLICATIONS

This application is a continuation-in-part of U.S. patent application Ser. No. 09/457,908, filed Dec. 8, 1999 now U.S. Pat. No. 6,338,320, which is a continuation-in-part of U.S. patent application Ser. No. 09/152,497 filed Sep. 9, 1998, now U.S. Pat. No. 6,044,815.

TECHNICAL FIELD

The present application is related to camless actuation of a valve. More particularly, the present application relates to actuation of a combustion engine intake/exhaust valve.

BACKGROUND OF THE INVENTION

Electrohydraulic valve actuators are known. Such actuators have facilitated research into the possible development of camless engines where timing the lift and closure of intake and exhaust valves for different engine speed and load conditions has the potential to improve efficiency and torque and to reduce emissions.

In the past, such actuators have been directly coupled to the valve to be actuated. The stroke of the actuator equaled the stroke of the valve to be actuated. Such an actuator is depicted in prior art FIG. 1. The actuator of FIG. 1 includes what has been described as a digital valve. The digital valve is fluidly coupled to a source of actuation fluid under pressure. The drive piston is directly coupled to the stem of the engine valve. Admitting such actuating fluid to bear on the drive piston strokes the piston downward, compressing the return spring and opening the engine valve. When the digital valve vents the actuating fluid, the return spring closes the engine valve. The stroke of the drive piston and the stroke of the engine valve are equal. There is no amplification of the stroke motion of the actuator piston. It can be a burden for the actuator to generate the desired engine valve stroke, as is described below.

A further embodiment of an actuator includes a motion amplifying servomechanism as depicted in FIG. 2, described in more detail in the parent application of the present application. In this mechanization, stroke motion amplification is achieved by hydraulic means. In this implementation, (U.S. Pat. No. 6,044,815), the secondary piston is mechanically attached to a poppet valve that controls the influx and efflux of air and combustion gases into and out of a cylinder of an internal combustion engine. The secondary piston is likewise constrained to move linearly between lower and upper limits, the difference of which approximates the required displacement of the poppet valve.

Through use of the servomechanism described, the motion of the hydraulically actuated secondary piston is made to faithfully track, or follow, the motion of the electromagnetically actuated main piston. This servomechanism is described in greater detail in U.S. Pat. No. 6,044,815.

To date, the mechanism used to provide this motion multiplication has been a "hydraulic spring" located between a second stage piston and a follower piston that precisely tracks the motion of the poppet valve. See FIG. 2. This type of mechanism takes advantage of the principle of mass continuity for incompressible fluids. That is, a displacement of the drive piston 26 is amplified and transmitted to the poppet-valve according to:

$$A_1X_1=A_2X_2$$

By proper choice of $A_1$ and $A_2$, suitable amplification is provided.

For practical purposes, it is extremely desirable to limit the stroke of both the first stage and the second stage pistons. Shorter stroke of the actuator valve 24 requires less magnetic force that means either a smaller solenoid may be employed and/or less electrical current is required. Shorter stroke of the hydraulically actuated second stage consumes less hydraulic fluid, though at higher actuating pressures. Both of these issues relate to cost and packaging of the needle valve actuator, and ultimately, to feasibility of implementation.

However, the poppet-valve motions required by the engine are dictated by engine performance and emissions restrictions, not cost and packaging. Therefore it is desirable to provide some mechanism to amplify the drive piston 26 motion and transmit this "amplified" motion to the poppet valve.

More generally, it is extremely desirable to limit the stroke of any hydraulic actuation applied to a poppet valve of an internal combustion engine. The hydraulic power required to drive such a system is proportional to the stroke of the hydraulic actuator used. As the strokes required of such a hydraulic actuator are large (typically equal to the required stroke of the poppet valve), the hydraulic power required to operate such a system tends to be quite large as well. This hydraulic power, coupled with the electrical power required to drive any control system required by the hydraulics, constitutes a parasitic loss on the engine, thus reducing effective engine output. This issue directly relates to cost and packaging of any hydraulic valve actuator, and ultimately, to feasibility of implementation. The lack of any commercially available electrohydraulic camless system on the market today is a testimony to this fact.

Therefore it is desirable to provide some mechanism to amplify the hydraulic actuator motion and transmit this "amplified" motion to the poppet valve.

SUMMARY OF THE INVENTION

The present invention substantially meets the aforementioned needs of the industry by providing for stroke amplification by mechanical means. Such means preferably include an actuator acting directly on a rocker arm, the rocker arm acting on the engine valve and amplifying the stroke of the actuator. The present invention amplifies the stroke of an actuator by mechanical means. The actuator may be a servomechanism and may be electronically controlled and hydraulically actuated.

The present invention is a valve actuator assembly for actuating a valve, the valve having a longitudinal axis includes an electrohydraulic actuator being displaced a lateral distance from the valve longitudinal axis, and a rocker arm being rotatable about a hinge point, a first arm portion extending from the hinge point to a proximal end and a second arm portion extending from the hinge point to a distal end, the proximal end being operably coupled to the second stage piston and the distal end being operably coupled to the valve, the fist arm portion being shorter than the second arm portion, the rocker arm spanning the lateral distance. The present invention is further a method of stroke amplification.

DETAILED DESCRIPTION OF THE DRAWINGS

Figure 1:
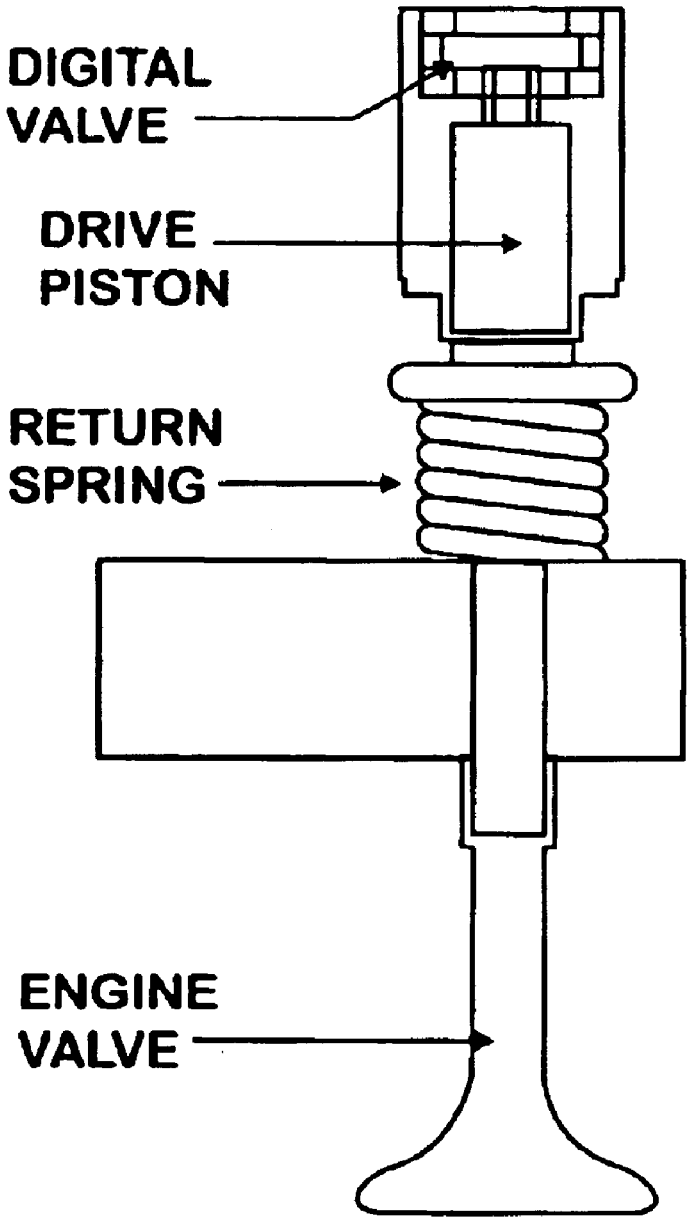
FIG. 1 PRIOR ART
FIG. 1 is a sectional side perspective view of a prior art actuator and engine valve.
Figure 2:
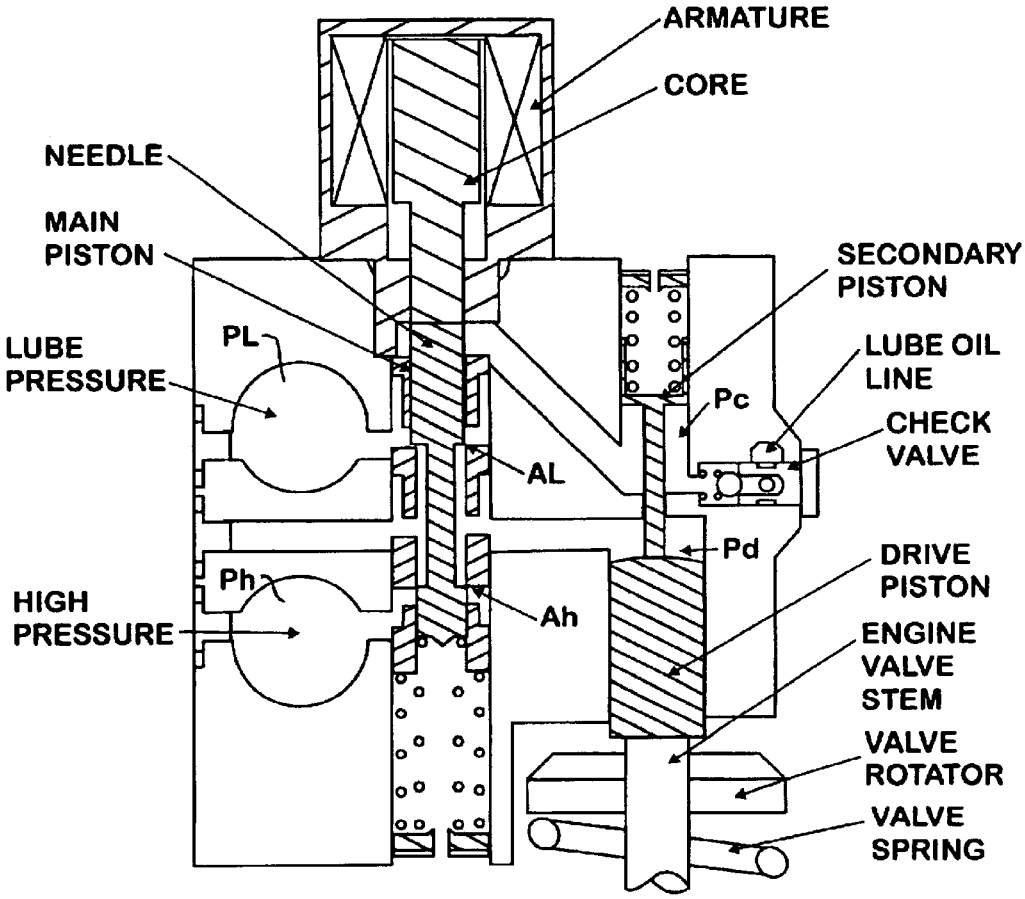
FIG. 2 is a sectional side perspective view of a prior art stroke amplifying actuator and engine valve.

The hydraulic motion multiplier described above is but one implementation of the motion multiplier concept. Motion multiplication may also be attained mechanically rather than hydraulically. With this point in mind, the present invention is detailed below.

The actuator assembly of the present invention is shown generally at 10 in the Figures. The actuator assembly 10 has two major components; actuator 12 and rocker arm 14. The actuator assembly 10 is designed to effect the opening and closing of a poppet valve, particularly an engine valve, either an intake or an exhaust valve 16. Engine valve 16 has a valve stem 18, a keeper 20 and a return spring 22. The return spring 22 typically biases the engine valve 16 in the closed disposition and opposes the action of the actuator assembly 10. Valve 16 has a longitudinal axis 23.

Figure 3:
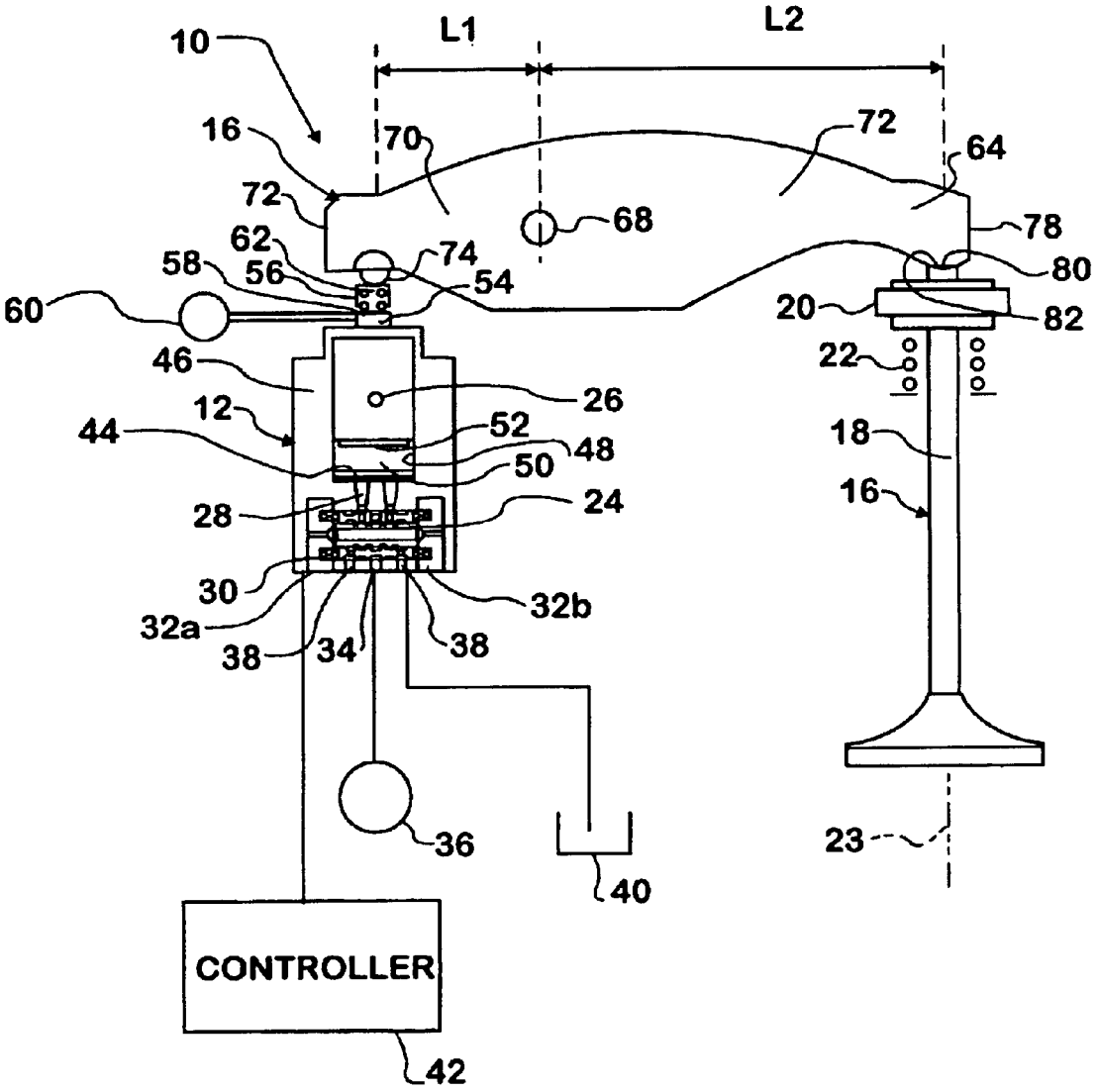
FIG. 3 is a sectional side perspective view of an actuator of the present invention and engine valve.

Referring to FIG. 3, the first component of the actuator assembly 10 is the actuator valve 24. The actuator valve 24 is laterally displaced from the axis 23. The actuator valve 24 may be any suitable valve but, as depicted in FIG. 3, includes a spool 28. The spool 28 is translatably disposed in a spool bore 30. Solenoids 32*a*, 32*b* are disposed proximate the opposed ends of the spool bore 30. In practice, one of the solenoids 32*a*, 32*b* could be replaced with a spring or other biasing means.

An inlet port 34 is fluidly coupled to the spool bore 30 and to a high pressure actuating fluid rail 36. The rail 36 may convey any suitable high pressure fluid. Preferably, the fluid in the rail 36 is engine oil at approximately 1,500 psi.

A vent port 38 is fluidly coupled to the spool bore 30 and to an ambient reservoir 40. The ambient reservoir 40 may be at substantially ambient pressure of 0 to 100 psi.

The solenoids 32*a*, 32*b* are in communication with a controller 42. The controller 42 is capable of sending signals to the solenoids 32*a*, 32*b* to effect translation of the spool 28 within the spool bore 30. At least one fluid passage 44 fluidly couples the spool bore 30 to the drive piston 26.

The drive piston 26 is translatably disposed in a cylinder 48 defined in a cylinder housing 46. A variable volume fluid chamber 50 is fluidly coupled to the fluid passage 44. The fluid chamber 50 is defined in part by the actuating surface 52 of the drive piston 26. A bearing surface 54 is opposed to the actuating surface 52. The bearing surface 54 is operably coupled to the rocker arm 14.

A hydraulic adjust mechanism 56 may be interposed between the rocker arm 14 and the bearing surface 54 in order to account for thermal dimensional changes occurring in the rocker arm 14 and the engine valve 16 under various engine operating conditions. The hydraulic adjust mechanism 56 may include a chamber 58 that is in fluid communication with a low pressure fluid, such as engine oil as approximately 50 psi. Additionally, the hydraulic adjust mechanism 56 may include a spring 62.

The second major component of the actuator assembly 10 is the rocker arm 14. The rocker arm 14 has an elongate arm member 64. The arm member 64 is pivotable about a pivot point 68. A first arm portion 70 extends leftward in the depiction of FIG. 3 from the pivot point 68 to the proximal end 72 of the arm member 64. A ball bearing 74 is disposed proximate the proximal end 72 for coupling to the drive piston 26. The first arm portion 70 has a length L1, defined between the pivot point 68 and the point of contact of the ball bearing 74 with the piston 26.

A second arm portion 76 of the arm member 64 extends rightward from the pivot point 68 to the distal end 78 of the arm member 64. A bearing surface 80 is presented proximate the distal end 78. The bearing surface 80 bears upon the stem upper margin 82 of the engine valve 16. The second arm portion 76 has a length, L2, defined between the pivot point 68 and the point of contact of the bearing surface 80 with the stem upper margin 82. L1 is preferably less than L2 to provide stroke amplification as discussed in more detail below.

Figure 4:
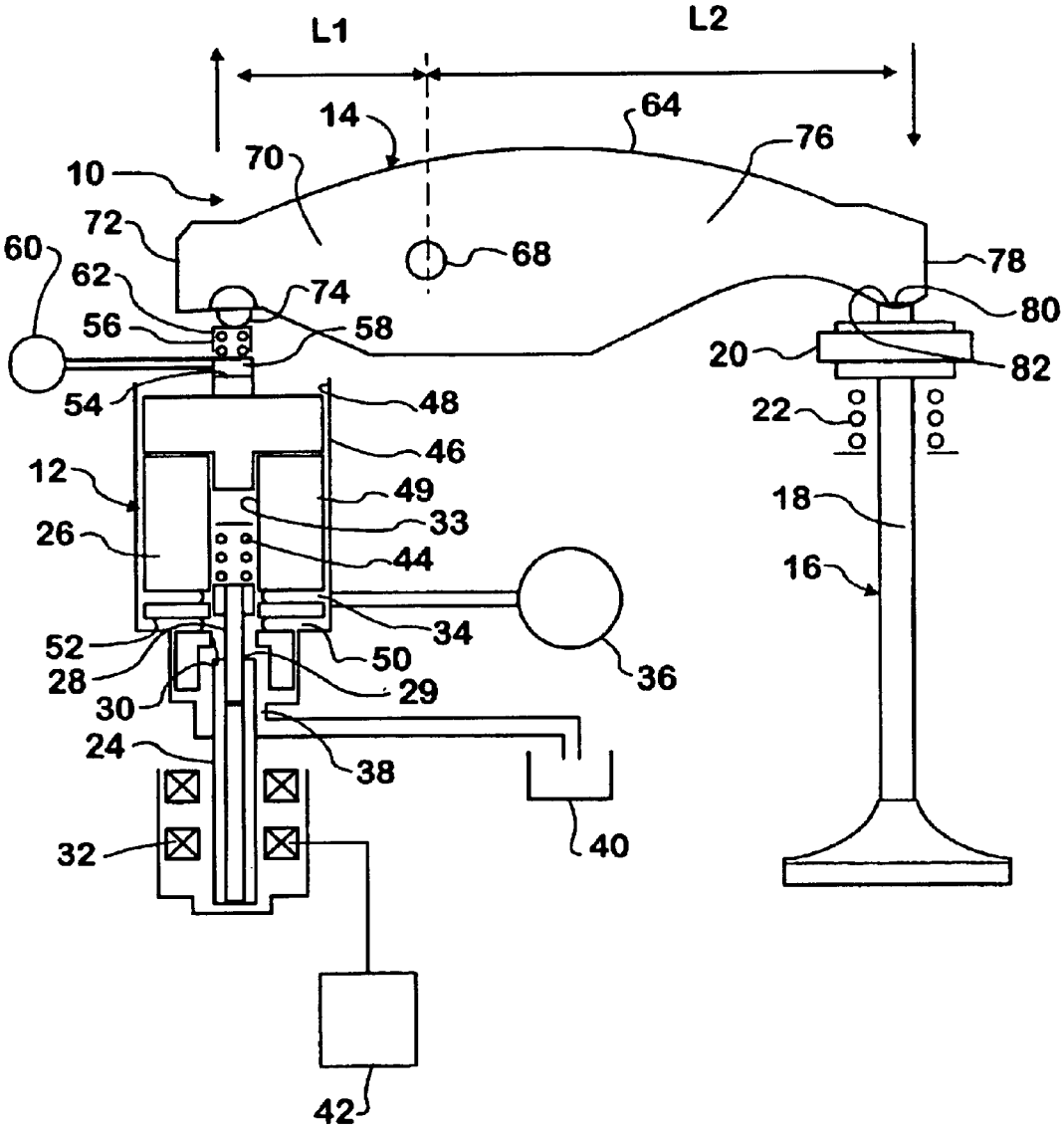
FIG. 4 is a sectional side perspective view of a further embodiment of an actuator of the present invention and engine valve.
Figure 5:
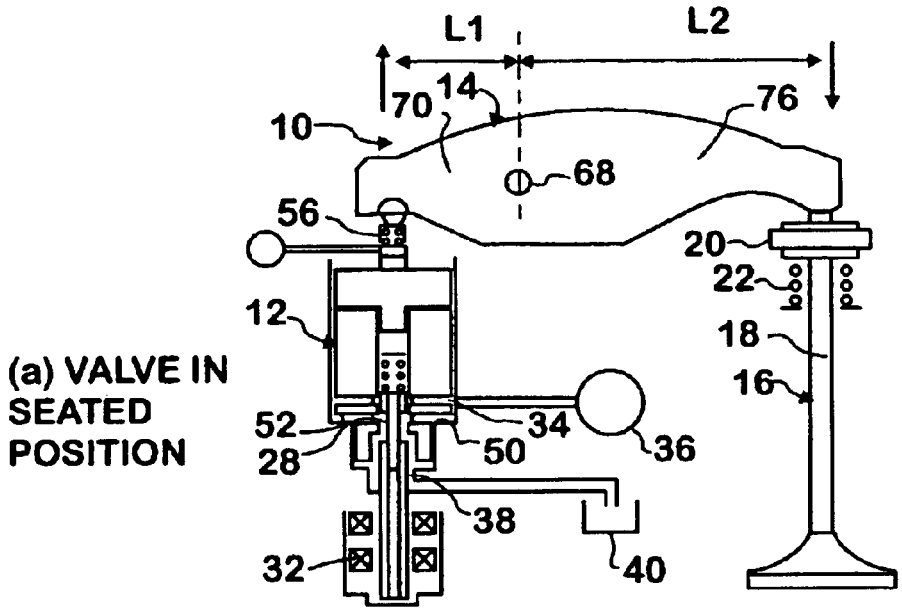
FIG. 5 is a sectional side perspective view of the embodiment of actuator of FIG. 4 and engine valve, the engine valve being in the closed disposition.
Figure 6:
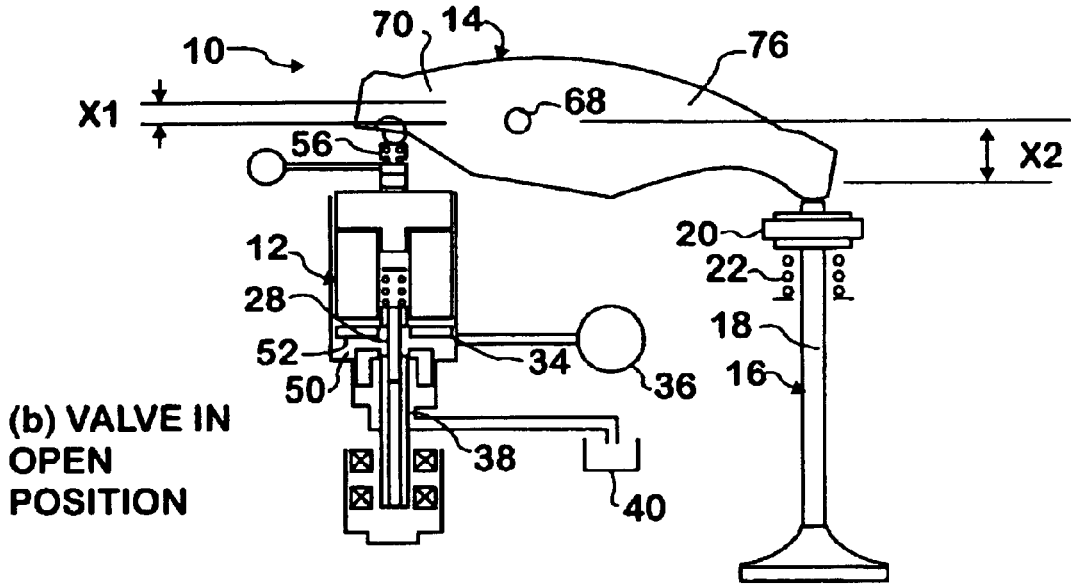
FIG. 6 is a sectional side perspective view of the embodiment of actuator of FIG. 4 and engine valve, the engine valve being in the open disposition.

A further preferred embodiment of the actuator assembly 10 is presented in FIGS. 4–6. Like components are indicated by like reference numerals throughout. This further embodiment of the actuator assembly 10 also includes an actuator 12 acting on a rocker arm 14 to effect the opening and closing of the engine valve 16.

The actuator 12 has two major subcomponents: the actuator valve 24 and drive piston 26. The actuator valve 24 is an elongate piston comprising a spool valve 28 at a first end and including a spool groove 29. The actuator valve 24 is translatably disposed in spool bore 30. A single solenoid 32 is disposed proximate a second end of the actuator valve 24. A return spring 33 bears on the end of the actuator valve 24 (top margin) that is disposed proximate the spool groove 29.

An inlet port 34 is fluidly coupled to the high pressure 36. The inlet port 34 is defined in the drive piston 26 and is in fluid communication with the spool bore 30. A vent port 38 is also in fluid communication with the spool 30 and is further fluidly coupled to the ambient reservoir 40. A controller 42 is in communication with the solenoid 32 for energizing and deenergizing the solenoid 32.

The second subcomponent of the actuator 12 is the drive piston 26. The drive piston 26 includes a cylinder housing 46 having a cylinder 48 defined therein. The drive piston 26 is translatably disposed in the cylinder 48. In the depiction of FIGS. 4–6, the drive piston 26 is depicted as a cylinder capped by a cap. It should be noted that the drive piston 26 could as well be a single unitary component.

An axial central actuator piston bore 49 is defined in the drive piston 26. The actuator piston bore 49 is an extension of the spool bore 30. The actuator valve 24 projects into the actuator piston bore 49, the actuator piston bore 49 accommodating translation of the actuator valve 24. Additionally, the return spring 33 is housed within the actuator piston bore 49, bearing on the top margin of the actuator valve 24.

A fluid chamber 50 is defined beneath the lower margin of the drive piston 26. The fluid chamber 50 is selectively in communication with the inlet port 34 as a function of the disposition of the spool groove 29 relative to both the fluid chamber 50 and the inlet port 34. The fluid chamber 50 is a variable volume chamber defined in part by the actuating surface 52, the actuating surface 52 defining the lower margin of the drive piston 26.

A bearing surface 54 is presented proximate the upper margin of the drive piston 26. A hydraulic adjust mechanism 56 as previously described may be interposed between the bearing surface 54 and the point of contact with the rocker arm 14.

The rocker arm 14 is substantially as described above with reference to the first preferred embodiment of the actuator assembly 10.

The actuator valve 24 is electromagnetically actuated by a solenoid 32. The actuator valve 24 is constrained to move linearly between a lower and an upper limit. Motion of the actuator valve 24 relative to the hydraulically actuated drive piston 26 sequentially opens and closes orifices (the groove 29 of spool 28) that control hydraulic fluid in fluid chamber 50 acting on the actuating surface 52 of the drive piston 26. In the closed disposition, depicted in FIG. 5, the vent port 38 and L.P. reservoir 40 are in fluid communication with fluid chamber 50. In the open disposition, depicted in FIG. 6, the inlet port 34 is in fluid communication with the fluid chamber 50 by means of the spool groove 29.

The function of this system is described below. The actuator valve 24 is actuated from rest (see FIG. 5) to the open valve disposition (see FIG. 6) by applying voltage to the solenoid 32. The actuator valve 24 then moves upward against its return spring 33 due to the magnetic force generated at the solenoid 32 responsive to an input signal from the controller 42. Displacement of the actuator valve 24 relative to the drive piston 26 sequentially closes the vent 38 connected to tank 40 and opens the inlet port 34 that allows high-pressure fluid to flow from the rail 36 through the spool groove 29 into the actuating chamber 50. The resulting hydraulic force acting on the actuating surface 52 displaces the drive piston 26 upward against the rocker arm 14. Use of a hydraulic adjust mechanism 56 in communication with engine lube oil pressure 60 allows compensation for thermal growth and/or tolerance deviations.

Motion of the drive piston 26 displaces the rocker arm 14 about its pivot point 68. The linear motion of the drive piston 26 is amplified and transmitted to the poppet valve 16 according to:

$$x_{poppetvalve} = x_{drivepiston}\left(\frac{L_2}{L_1}\right),$$

where $L_2>L_1$. See FIGS. 3 and 4.

At the appropriate time, dictated by engine performance and emissions constraints, the poppet valve 16 is returned to its seat as follows. The actuator valve 24 is first returned to its initial position by the controller 42 removing the applied solenoid 32 voltage. The return spring 33 overcomes any residual magnetic force and returns the actuator valve 24 to its seat, as depicted in FIG. 5. Motion of the actuator valve 24 relative to the drive piston 26 sequentially closes the inlet port 34 connected to the high-pressure rail 36 and opens the vent orifice 38 connected to the tank 40. Hydraulic pressure is thus removed from the drive piston 26, which is then forced to return to its seat by the return spring 22 connected to the poppet valve 16.

A constraint on the hydraulic surfaces of the second drive piston 26 is as follows:

$$F_{hydraulic} = F_{returnspring}\left(\frac{L_2}{L_1}\right)$$

In other words, the hydraulic force supplied to the drive piston 26 must overcome the "amplified" return spring force exerted by the return spring 22. This force requirement may be accommodated by a larger area actuation surface 52 on the drive piston 26, or by supplying higher pressure actuating fluid from the rail 36.

Motion of the drive piston 26 is amplified and transmitted to the poppet valve 16 via the mechanical rocker arm 14. This implementation provides the following advantages over the earlier hydraulic amplification implementation:

1. The effectiveness of the amplification is unaffected by variations in system pressure, fluid leakage, or system operating temperature.
2. The use of the rocker arm 14 facilitates greater packaging flexibility by removing the hydraulics from a position along the longitudinal axis 23 of poppet valve 16 motion. With the hydraulics displaced laterally, it is possible to reduce the height of the engine head(s) and allow incorporation of larger or additional hydraulic rail volumes.
3. With the hydraulics displaced laterally, it is possible to realize improved serviceability of existing in-head engine hardware, including injectors, due to the packaging flexibility described in point 2 above.
4. This implementation utilizes hardware that is inexpensive, time-tested, and commonly used on current internal combustion engines.
5. Use of the rocker arm in no way precludes or inhibits any of the functionality of the actuator described in U.S. Pat. No. 6,044,815.

The rocker arm ratio employed here is limited only by packaging and available force constraints.

Figure 7:
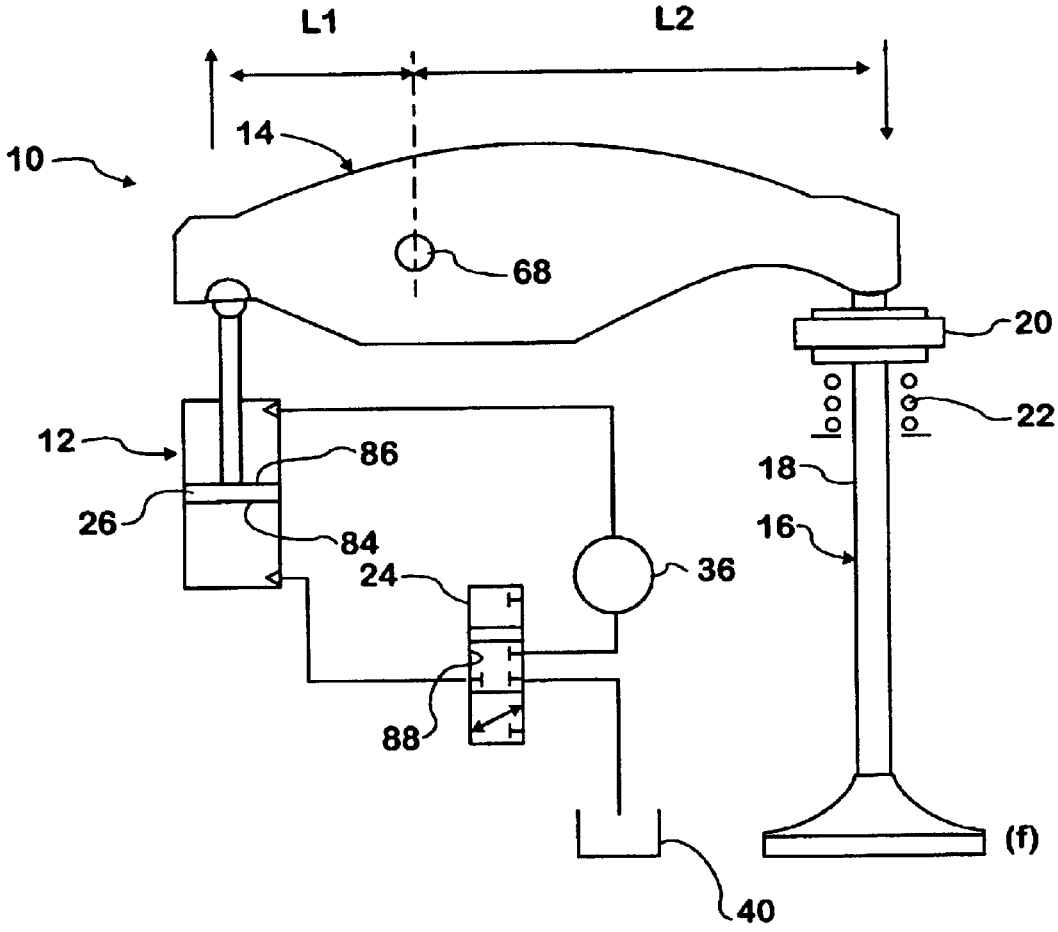
FIG. 7 is a schematic diagram of a rocker arm motion multiplier.

A more general rocker arm motion multiplier is depicted in FIG. 7. Motion of the hydraulic actuator 12 is amplified and transmitted to the poppet valve 16 via a mechanical rocker arm 14.

Poppet 14 motion is initiated as follows: the control valve 24 is positioned so as to connect a high-pressure source of fluid 36 to the actuation side 84 of the drive piston 26. As this same high pressure is also connected to the return side 86 of the actuator, the differential hydraulic area inherent to the 2-way actuator creates a net force necessary for drive piston 26 motion. The drive piston 26 will continue to move until either the control valve 24 position is changed or the drive piston 26 encounters a mechanical hard stop.

Motion of the drive piston 26 displaces the rocker arm 14 about the pivot point 68. The linear motion of the drive piston 26 is amplified and transmitted to the poppet valve 16 according to:

$$x_{poppetvalve} = x_{drivepiston}\left(\frac{L_2}{L_1}\right)$$

where $L_2>L_1$. See FIG. 7.

The drive piston 26 is returned to its initial seated position as follows: The control valve 24 is first returned to its initial position, connecting the actuation chamber 88 with the 2-way control valve 24 with a low-pressure source, the tank 40. As the return side 86 of the 2-way control valve 24 is still connected to the high pressure source 36, a net force is created in the opposite return direction, allowing the drive piston 26 and the poppet valve 16, to return to their initial seated positions.

While a 2-way hydraulic actuator 24 is described above, the same claims may be made in relation to the rocker arm mechanical motion multiple applied to a 1-way hydraulic actuator 12 with spring return 22 used to actuate a poppet valve 16 of an internal combustion engine.

A constraint on the hydraulic surfaces of the hydraulic actuator 12 is as follows:

$$F_{hydraulic} = F_{returnspring}\left(\frac{L_2}{L_1}\right)$$

In other words, the hydraulic force supplied to the drive piston 26 must overcome the "amplified" return spring 22 force. This force requirement may be accommodated by a larger actuation surface of the actuation side 84 on the drive piston 26, or by supplying higher pressure from the rail 36.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A camless valve actuator assembly for actuating an engine valve, comprising:

an electrohydraulic actuator obtaining no external mechanical input and having a piston being translatable responsive to an actuating fluid bearing on a piston surface, the piston surface being in fluid communication with an actuator valve, the actuator valve being in selective fluid communication with a source of actuating fluid under pressure, the actuator valve being shiftable to selectively port and vent actuating fluid to and from the piston surface; and a rocker arm being rotatable about a hinge point, a first arm portion extending from the hinge point to a proximal end and a second arm portion extending from the hinge point to a distal end, the proximal end being operably coupled to the piston and the distal end being operably coupled to the valve, the first arm portion being shorter than the second arm portion, the piston generating a lineal translation that is imparted to the rocker and proximal end for imparting substantially all of an opening activation to the valve.

2. The valve actuator assembly of claim 1, the electrohydraulic actuator being displaced laterally from a valve longitudinal axis.

3. The valve actuator assembly of claim 1, the actuator valve being actuated by at least one solenoid.

4. The valve actuator assembly of claim 3, the actuator valve being actuated by a first solenoid and an opposed spring.

5. The valve actuator assembly of claim 1, the source of actuating fluid under pressure being a high pressure rail.

6. The valve actuator assembly of claim 1, the actuating fluid being engine lubricating oil.

7. The valve actuator assembly of claim 1, a hydraulic adjust mechanism being disposed intermediate the electrohydraulic actuator piston and the rocker arm.

8. The valve actuator assembly of claim 1, the actuator valve being in selective fluid communication with a reservoir at substantially ambient pressure.

9. A camless valve actuator for actuating an engine valve, comprising:

a hydraulically actuated servomechanism obtaining no external mechanical input and having an actuator valve and a drive piston, motion of the actuator valve relative to the drive piston acting to open and close certain orifices for controlling fluid acting on the drive piston; and a rocker arm being rotatable about a hinge point, a first arm portion extending from the hinge point to a proximal end and a second arm portion extending from the binge point to a distal end, the proximal end being operably coupled to the drive piston and the distal end being operably coupled to the valve, the first arm portion being shorter than the second arm portion, the piston generating a linear translation that is imparted to the rocker arm proximal end for imparting substantially all of an opening activation to the valve.

10. The valve actuator assembly of claim 9, the electrohydraulic actuator being displaced laterally from a valve longitudinal axis.

11. The valve actuator assembly of claim 9, the actuator valve being actuated by at least one solenoid.

12. The valve actuator assembly of claim 11, the actuator valve being actuated by a first solenoid and an opposed spring.

13. The valve actuator assembly of claim 9, the source of actuating fluid under pressure being a high pressure rail.

14. The valve actuator assembly of claim 9, the actuating fluid being engine lubricating oil.

15. The valve actuator assembly of claim 9, a hydraulic adjust mechanism being disposed intermediate the electrohydraulic actuator piston and the rocker arm.

16. The valve actuator assembly of claim 9, the actuator valve being in selective fluid communication with a reservoir at substantially ambient pressure.

17. A camless valve actuator assembly for actuating an engine valve, the valve having a longitudinal axis comprising:

an electrohydraulic actuator obtaining no external mechanical input being displaced a lateral distance from the valve longitudinal axis; and a rocker arm being rotatable about a hinge point, a first arm portion extending from the hinge point to a proximal end and a second arm portion extending from the hinge point to a distal end, the proximal end being operably coupled to the second stage piston and the distal end being operably coupled to the valve, the first aim portion being shorter than the second arm portion, the rocker arm spanning the lateral distance, the actuator generating a linear translation that is imparted to the rocker arm first end for imparting substantially all of an opening actuation to the valve.

18. The valve actuator assembly of claim 17, the electrohydraulic actuator having a piston being translatable responsive to an actuating fluid bearing on a piston surface, the piston surface being in fluid communication with an actuator valve, the actuator valve being in selective fluid communication with a source of actuating fluid under pressure, the actuator valve being shiftable to selectively port and vent actuating fluid to and from the piston surface.

19. The valve actuator assembly of claim 18, the electrohydraulic actuator being displaced laterally from a valve longitudinal axis.

20. The valve actuator assembly of claim 19, the actuator valve being actuated by at least one solenoid.

21. The valve actuator assembly of claim 20, the actuator valve being actuated by a first solenoid end an opposed spring.

22. The valve actuator assembly of claim 18, the source of actuating fluid under pressure being a high pressure rail.

23. The valve actuator assembly of claim 18, the actuating fluid being engine lubricating oil.

24. The valve actuator assembly of claim 18, a hydraulic adjust mechanism being disposed intermediate the electrohydraulic actuator piston and the rocker arm.

25. The valve actuator assembly of claim 18, the actuator valve being in selective fluid communication with a reservoir at substantially ambient pressure.

26. The valve actuator assembly of claim 17, the hydraulically actuated servomechanism having an actuator valve and a drive piston, motion of the actuator valve relative to the drive piston acting to open and close certain orifices for controlling fluid acting on the drive piston.

27. The valve actuator assembly of claim 26, the electrohydraulic actuator being displaced laterally from a valve longitudinal axis.

28. The valve actuator assembly of claim 26, the actuator valve being actuated by at least one solenoid.

29. The valve actuator assembly of claim 28, the actuator valve being actuated by a first solenoid and an opposed spring.

30. The valve actuator assembly of claim 26, the source of actuating fluid under pressure being a high pressure rail.

31. The valve actuator assembly of claim 26, the actuating fluid being engine lubricating oil.

32. The valve actuator assembly of claim 26, a hydraulic adjust mechanism being disposed intermediate the electrohydraulic actuator piston and the rocker arm.

33. The valve actuator assembly of claim 26, the actuator valve being in selective fluid communication with a reservoir at substantially ambient pressure.

34. A method of stroke amplification for an engine valve, comprising:

controlling an actuator electrically;

selectively porting an actuating fluid to an actuator piston responsive to a controlling command;

stroking the actuator piston a certain stroke length the stroke length being sufficient to impart to a valve substantially all of a valve opening stroke without resort to any external mechanical input;

rotating a rocker arm about a hinge point by means of the piston stroke; and amplifying the piston stroke by means of the rocker arm having a first arm portion extending from the binge point to a proximal end and a second arm portion extending from the binge point to a distal end, the proximal end being operably coupled to the second stage piston and the distal end being coupable to the valve to be stroked, the first arm portion being shorter than the second arm portion.

35. The method of claim 34, including laterally displacing the electrohydraulic actuator from a valve longitudinal axis.

36. The method of claim 34, including actuating the actuator valve by at least one solenoid.

37. The method of claim 36, including actuating the actuator valve by a first solenoid and an opposed spring.

38. The method of claim 34, including providing the source of actuating fluid under pressure by means of a high pressure rail.

39. The method of claim 34, including providing engine lubricating oil as the actuating fluid.

40. The method of claim 34, including hydraulically adjusting an interface disposed intermediate the electrohydraulic actuator piston and the rocker arm.

41. The method of claim 34, including selectively fluidly communicating the actuator valve with a reservoir being at substantially ambient pressure.

* * * * *